US005348520A

United States Patent [19]

Chang

[11] Patent Number: 5,348,520

[45] Date of Patent: Sep. 20, 1994

[54] EXERCISE STEPPER

[76] Inventor: Shao-Ying Chang, No. 764, Chung Shan South. Road, Yang Mei, Taoyuan, Taiwan

[21] Appl. No.: 151,818

[22] Filed: Nov. 15, 1993

[51] Int. Cl.[5] ..... A63B 22/04

[52] U.S. Cl. ..... 482/52; 482/123

[58] Field of Search ..... 482/51, 52, 53, 123, 482/129, 122, 125, 130, 131, 133, 136, 137

[56] References Cited

U.S. PATENT DOCUMENTS

| | | | |
|---|---|---|---|
| 3,428,312 | 2/1969 | Machen | 482/123 |
| 4,863,163 | 9/1989 | Wehrell | 482/129 |
| 5,112,287 | 5/1992 | Brewer | 482/123 |
| 5,178,591 | 1/1993 | Lyons | 482/52 |
| 5,199,934 | 4/1993 | Lin | 482/52 |
| 5,230,676 | 7/1993 | Terauds | 482/53 |

*Primary Examiner*—Stephen R. Crow

*Attorney, Agent, or Firm*—Burns, Doane, Swecker & Mathis

[57] ABSTRACT

An improved exercise stepper has a base, a pair of treadle pedals pivotably connected by the front ends thereof to each side of the supporting portion at the front end of the base, a lever device longitudinally swingably mounted in the base and a pair of oil pressure cylinders extensibly and swingably located between the front portion of the base and the bottoms of the pair of treadle pedals. The pair of treadle pedals are provided in the interior thereof each with an extensible type flexible rope pulling device formed by the free end extending to the outside on the front part of the treadle pedal and the other part being supported by a set of pulley wheels.

4 Claims, 3 Drawing Sheets

EXERCISE STEPPER

FIELD AND BACKGROUND OF THE INVENTION

Present invention relates to a stepping machine and, more particularly, to an improved exercise stepper where by stamping alternately on the resistant treadle pedals to exercise one's foot strength the same time enables also a training of one's arm strength thereby achieving the purpose of body exercises.

Recently, the conventional stepping machine for exercise, also known as walk exerciser, has for its advantages such as: a simple mechanism, small size, occupying less room space, being convenient to carry with and suitable for use at whatever place and time by persons irrespective of their sex and age, become very popular among people. This stepping exercise machine generally comprises a pair of tread boards, a pair of oil pressure cylinders and a base. However, because the supporting surface of the machine has a width about the same as the breadth of one's shoulder and a length of about 50 cm only, and also because there is difference in height on the two sides, it has resulted in the center of weight being less stable when a user stands exercising on it. Moreover, for safety one must rely on swaying both hands to keep balance on the machine, or if not, one gets slipped off easily. To avoid such a drawback, there has been added by mounting at the front part of the machine a handrail for use at keeping balance or use of an independent complementary stand or handgrip to assist at keeping up stability. However, by so doing there would have to increase the size and weight of the machine in entirety and would also be need of a larger space for storage. It would thus become relatively inconvenient to carry with and for storage. In addition, the conventional stepping exercise machine offers for leg exercise only and is not able to serve also in the exercise of our arms. Although in a further example of the known stepping exercise machine, a swingable handgrip is provided which permits exercise of arms the same time when stepping exercise is practiced, this handgrip, nevertheless, like the supporting handrail described above, would occupy space and thus hamper storage.

SUMMARY OF THE INVENTION

Accordingly, an object of the present invention is to provide an improved exercise stepper having a flexible rope pulling mechanism which permits a user to take arm exercise simultaneously with the stepping exercise.

A further object of the present invention is to provide an exercise stepper having a flexible rope pulling mechanism capable of being collected in the lower parts of the treadle pedals and not occupying other, spaces, the flexible rope pulling mechanism being also capable of serving as a flexible handle to assist in keeping balance of the body.

A still further object of the present invention is to provide an exercise stepper having a simple lever mechanism to cooperate with the action of the treadle pedals.

Other objects and features of the present invention will be apparent from a detailed description of the invention in conjunction with the following accompanying drawings.

DESCRIPTION OF PREFERRED EMBODIMENTS OF THE INVENTION

Now, referring to the accompanying drawings, a detailed description of a preferred embodiment of the present invention is as follows.

Figure 1:
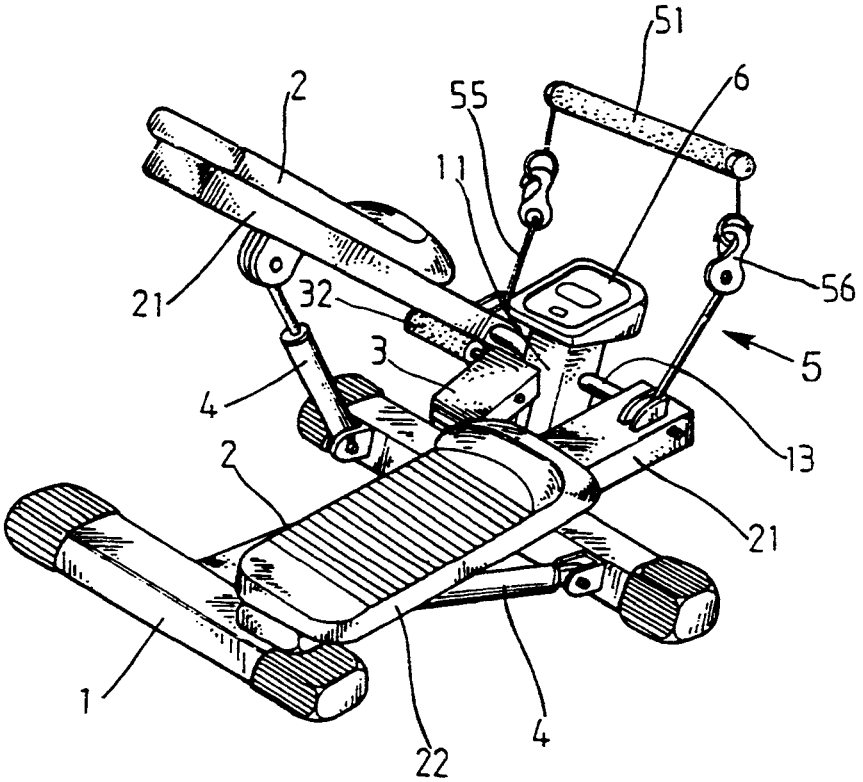
FIG. 1 is a perspective view of an exercise stepper of the present invention.
Figure 2:
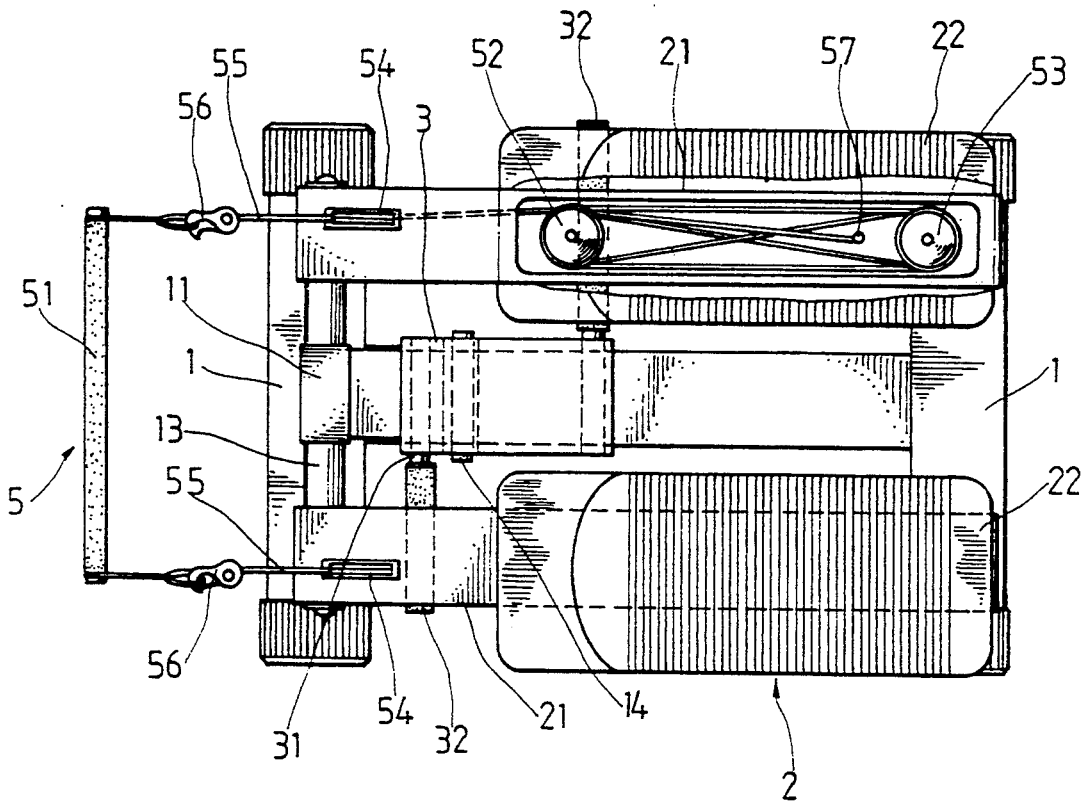
FIG. 2 is a top view of the exercise stepper partially cut off.

Referring first to FIGS. 1 and 2, the exercise stepper of the present invention mainly comprises: a base 1, a pair of treadle pedals 2 having the front ends pivotally supported on the front end of the base 1 by a transverse shaft 13, a swinging lever 3 longitudinally swingably mounted on the front portion of the base 1 by a pivot 14 to support the pair of treadle pedals 2, a pair of oil pressure cylinders 4 located between the slightly rear lower parts of the pair of treadle pedals 2 and the front part of the base 1 for-use in bestowing upon the treadle pedals a resistance force to stamping, and a pair of flexible rope pulling devices 5 distensibly located in concealment in the interior of the pair of treadle pedals 2 and having the one ends with, for example, a handgrip or pull ring 51,extending respectively on the outer side front ends of the treadle pedals 2.

In the present embodiment, the base I forms a basement made of a flat iron tube resembling an H in shape and provided vertically at the front end thereof with two vertical pillars 11, 12 such that it is capable of keeping stability and reducing size and weight. It is obvious, however, that this base 1 may be made of any materials in various suitable shapes to keep stability.

Generally, the treadle pedals 2 has comprise a flat long hollow piece 21 as the base of treadle pedal and a broader and shorter tread board 22 which is mounted on the rear part of the flat long piece 21. This treadle base piece 21 is made of flat iron tube whereas the tread board body 22 is formed by molding of plastics. Obviously, these two parts may also be formed of aluminum alloy and other industrial plastic materials of sufficient strength, and both parts may be made of one material or of different materials. Furthermore, the treadle base piece 21 and the tread board body 22 may also be integrally formed. The above two treadle pedals 22 are formed by the front end of the corresponding treadle base piece 21 being rotatably pivotally supported by a transverse shaft 13 on each side of the pillar 11 at the front part of the base 1 to be in an one-up and one-down position as shown in FIGS. 1 and 2.

The swinging lever 3 is made of channel-section iron and is longitudinally swingably connected by a pivot 14 to the pillar 12 of the base 1. On each side of the lever 3 are located one behind the other two rollers 32 which are supported on the shaft 31 to be just in touch with the bottoms of the pair of the left and right treadle base pieces 21.

A pair of oil pressure cylinders 4, 4, as of a known art, are pivotally connected by the cylinder end and the piston rod 41 end respectively thereof to the front portion of the base 1 and the more rear part bottom surface of the treadle pedals 2, and are capable of extending, withdrawing and pivoting following the treadle pedals 2 being stamped on alternately up and down.

Figure 3:
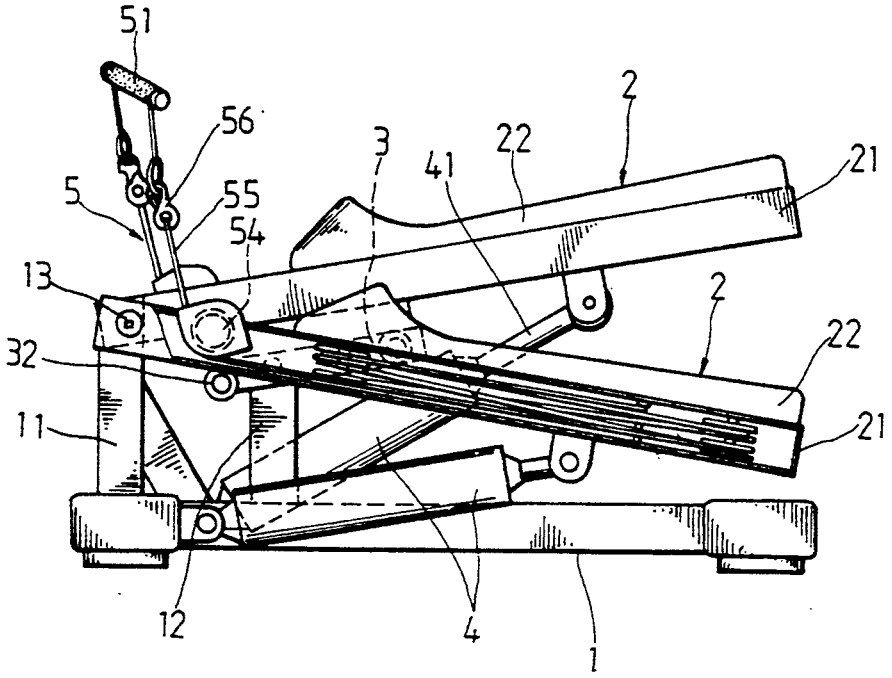
FIG. 3 is a side view of the exercise stepper partially cut off.
Figure 4:
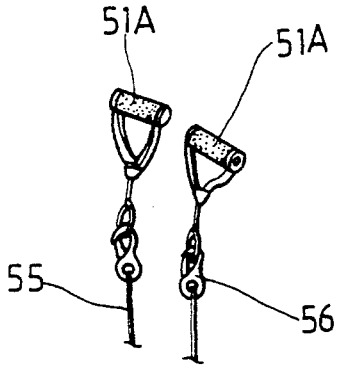
FIG. 4 is a schematic view of the essential part of another embodiment of the exercise stepper.

As shown in FIGS. 2 and 3, a rope pulling device 5 is provided inside each of the hollow parts of the two treadle base pieces 21, including: a pair of rotatably longitudinally arranged transverse double pulley wheels 52, 53, a vertical guide wheel 54 rotatably mounted at the front most end of the base pieces 21 and a flexible pull rope 55 having one end fixed to a fixed pin 57 by the pin on the inside rear part of the base piece 21 and the other end being pulled out of the base piece 21 by the guide wheel 54 lying perpendicular to the base piece after it having wound to the above two transverse pulleys 52, 53. The pulled-out end of this flexible pull rope 55, that is, the free end, is connected to a loose safety hook hitch 56 and between the two hook hitches 56 may be detachably mounted a handle 51. As shown in FIG. 4, this handle 51 may also be made as two separate handgrips or pull rings 51A.

Moreover, depending on necessity at the upper part of the pillar 11 and the front part of the base 1 may be mounted a counter or an electronic timepiece 6.

With a construction as described above, the stepper of the present invention not only enables a user to stamp two feet on the treadle pedals to do exercises as with the conventional stepper, but is also used by the user for holding on the handle 51 or handgrips 51A with both hands and forcefully pulling and releasing the flexible rope against the elastic extension force of the pull rope to practice arm exercises. After use, the rope is withdrawn in the interior of the treadle base pieces and only the hook hitch ends are exposed to the outside of the base pieces. Furthermore, the handle may also be folded in the treadle pedals or be removed outland folded in the treadle pedals and because there is no substantial increase in the entire size of the stepper, it can be packed tightly and kept in storage.

Thus, an improved exercise stepper has been disclosed. While a preferred embodiment of the subject invention has been described in some detail, it is apparent that a person of ordinary skill could make obvious modifications thereto without departing from the scope of the subject invention as defined by the appended claims.

I claim:

1. An exercise stepper, comprising:

a base, a pair of treadle pedals pivotally connected by the front ends thereof to either side on a supporting portion of the front end of said base, a lever device longitudinally swingably pivoted to said base, and a pair of oil pressure cylinders extensibly and swingably mounted on the front portion of said base and the bottoms of said pair of treadle pedals; characterized in that said pair of treadle pedals are provided in their interiors each with an extensible-type flexible rope pulling device formed by the free end thereof extending to the outside in front of the respective treadle pedal, and the rope pulling device being supported by a set of pulley wheels located within said interiors.

2. An exercise stepper according to claim 1, wherein said pair of rope pulling devices are connected at their free ends each by a loose safety hook hitch and the two hook hitches have a common handle detachably connected between said hook hitches.

3. An exercise stepper according to claim 1, wherein said pair of rope pulling devices are connected at their free ends each by a loose safety hook hitch and the two hook hitches each have a separate handgrip connected detachably therefrom.

4. An exercise stepper according to claim 1, wherein said lever device comprises a lever body made of channel-section iron, a pair of transverse supporting shafts disposed respectively on the lateral side front part and on another lateral side rear part of said lever body and a pair of rollers rotatably inserted on said pair of transverse supporting shafts.

* * * * *